US005460914A

United States Patent [19]

Sasaki et al.

[11] Patent Number: 5,460,914

[45] Date of Patent: Oct. 24, 1995

[54] TONER, METHOD FOR MANUFACTURING SAME, AND IMAGING APPARATUS USING SAME

[75] Inventors: Hiroshi Sasaki, Toukai; Kishiro Iwasaki, Hitachioota; Kenji Murao, Hitachi, all of Japan

[73] Assignee: Hitachi, Ltd., Tokyo, Japan

[21] Appl. No.: 191,188

[22] Filed: Feb. 3, 1994

[30] Foreign Application Priority Data

Feb. 10, 1993 [JP] Japan ..... 5-022360
Sep. 17, 1993 [JP] Japan ..... 5-231258

[51] Int. Cl.[6] ..... G03G 9/08; G03G 15/08

[52] U.S. Cl. ..... 430/109; 430/111; 118/653

[58] Field of Search ..... 430/109, 111; 118/653

[56] References Cited

U.S. PATENT DOCUMENTS 5,328,792 7/1994 Shigemori et al. ..... 430/111 X

FOREIGN PATENT DOCUMENTS 0445986 9/1991 European Pat. Off. .
279864 12/1986 Japan ..... 430/111
2258053 1/1993 United Kingdom .

*Primary Examiner*—Roland Martin
*Attorney, Agent, or Firm*—Antonelli, Terry, Stout & Kraus

[57] ABSTRACT

The present invention aims to provide a deformed toner having a narrow toner particle size distribution, a simple manufacturing method of same, and an imaging apparatus using same.

The toner particles are characterized in having an average diameter of d (d is in a range of 4–15 μm), and that a volumetric fraction of the particles having the diameter in a range of d±0.2 d equals to or exceeds 90% of total volume of the particles, and further, when a specific surface area of the toner per 1 $cm^3$ determined by a BET method is expressed by A ($m^2/g$) and a specific gravity of the particle is expressed by D ($g/cm^3$), A of the particles stands in a range expressed by an equation, $7/(D \cdot d) \leqq A \leqq 10/(D \cdot d)$.

An image having a preferable definition can be obtained by improving a resolution of image by making the particle size distribution of toner particles narrow, and providing the toner having an electrification charge at least 10 μC/g with a narrow distribution.

12 Claims, 2 Drawing Sheets

TONER, METHOD FOR MANUFACTURING SAME, AND IMAGING APPARATUS USING SAME

BACKGROUND OF THE INVENTION (1) Field of the Invention

The present invention relates to a toner having a deformed spherical shape of substantially a same particle size, an easy method for obtaining same, and an imaging apparatus using same. The term "deformed" here means "processed for having a shape of other than a substantially exact sphere", and the same hereinafter.

(2) Description of the Prior Art

Solid ink called toner is widely used in image forming methods such as electronic photograph, and electrostatic recording method etc. As for a general method for manufacturing the toner, a method has been used in which resin and additives such as coloring agents are mixed together, the mixture is pulverized into particles having small diameters, and subsequently the particles are classified in order to obtain particles having adequate diameters.

Currently, so-called polymerized toner capable of being manufactured without the pulverization and the classification has widely been studied (JP-A-57-154253 (1982)). The polymerized toner is manufactured without the pulverizing operation after polymerization of the resin by controlling a particle size distribution to an adequate one for toner particles when the resin is produced by a suspension polymerization method or an emulsion polymerization method.

The toner particles obtained by the above methods have a narrower particle size distribution than that of the particles obtained by the pulverization method, and accordingly, the classification of the particles is not necessary.

Further, the toner particle obtained by the above method has a smaller surface area than that of the toner particle obtained by the prior art, and accordingly, the toner particle has an advantage of being small hygroscopic.

When the toner is manufactured by a polymerization method, the process has the steps of polymerizing the resin, settling the particles by centrifuging, removing dispersing agents by repeating the settling and decanting after adding water to the particles, and drying the particles. The above described process is complex in its operation, and is more disadvantageous in necessary time and cost than the conventional pulverization method.

Further, the particles obtained by the polymerization method have a problem that the particle is substantially an exact spherical shape, although the particles have a relatively same diameter. When the particle is an exact sphere, the particle has a small surface area, and has had a problem for being used as a toner such as a poor charging property because of a very small contacting area with a developing object, e.g. a drum and paper, at a developing operation.

In order to overcome the above described problem, a several methods for deforming the particles are studied. For example, a method wherein a fine particle obtained by another polymerization method is attached to the particle obtained by the above polymerization method (JP-A-1-10263 (1989)), and methods for obtaining deformed particles by pulverizing the particles obtained by the polymerization method with giving physical impact by a ball milling and so on have been proposed. However, all of the example methods have a problem that the toner particles having substantially a same diameter are very difficult to be obtained without the classification because the attached fine particle in the former case and generated fine particles by the ball milling in the latter cases expand a width of their particle diameter distribution.

SUMMARY OF THE INVENTION (1) Object of the Invention

Object of the present invention is to provide a toner having a deformed spherical shape of substantially a same particle size, an easy method for obtaining same, and an imaging apparatus using same.

(2) Methods Solving the Problems

In order to realize the above described object of the present invention, the following means are effective;

The first mean is toner particles having an average diameter of d (d is in a range of 4–15 μm) characterized in that a volumetric fraction of the particles having the diameter in a range of d±0.2 d equals to or exceeds 90% of total volume of the particles, and further, when a specific surface area of the toner per 1 $cm^3$ determined by a BET method is expressed by A ($m^2/g$) and a specific gravity of the particle is expressed by D ($g/cm^3$), A of the particles stands in a range expressed by an equation, $7/(D\cdot d) \leqq A \leqq 10/(D\cdot d)$ .

The second mean is toner particles having an average diameter of d (d is in a range of 4–15 μm) characterized in that a volumetric fraction of the particles having the diameter in a range of d±0.2 d equals to or exceeds 90% of total volume of the particles, further, when a specific surface area of the toner per 1 $cm^3$ determined by a BET method is expressed by A ($m^2/g$) and a specific gravity of the particle is expressed by D ($g/cm^3$), A of the particles stands in a range expressed by an equation, $7/(D\cdot d) \leqq A \leqq 10/(D\cdot d)$ , and of which surface has irregularities of utmost 2 μm deep.

The third mean is toner particles having an average diameter of d (d is in a range of 4–15 μm) characterized in that a volumetric fraction of the particles having the diameter in a range of d±0.2 d equals to or exceeds 90% of total volume of the particles, further, when a specific surface area of the toner per 1 $cm^3$ determined by a BET method is expressed by A ($m^2/g$) and a specific gravity of the particle is expressed by D ($g/cm^3$), A of the particles stands in a range expressed by an equation, $7/(D\cdot d) \leqq A \leqq 10/(D\cdot d)$, and of which (a)/(b) is less than 2 where (a) is a major axis and (b) is a minor axis of the toner particle, respectively.

The fourth mean is toner particles having an average diameter of d (d is in a range of 4–15 μm) characterized in that a volumetric fraction of the particles having the diameter in a range of d±0.2d equals to or exceeds 90% of total volume of the particles, further, when a specific surface area of the toner per 1 $cm^3$ determined by a BET method is expressed by A ($m^2/g$) and a specific gravity of the particle is expressed by D ($g/cm^3$), A of the particles stands in a range expressed by an equation, $7/(D\cdot d) \leqq A \leqq 10/(D\cdot d)$, and of which absolute charged electricity is at least 10 μC/g (determined with a blow off charged electricity measuring apparatus).

The fifth mean is toner particles having an average diameter of d (d is in a range of 4–15 μm) characterized in that a volumetric fraction of the particles having the diameter in a range of d±0.2 d equals to or exceeds 90% of total volume of the particles, further, when a specific surface area of the toner per 1 $cm^3$ determined by a BET method is expressed by A ($m^2/g$) and a specific gravity of the particle is expressed by D ($g/cm^3$), the A of the particles stands in a range expressed by an equation, $7/(D \cdot d) \leqq A \leqq 10/(D \cdot d)$, and a volumetric fraction of the particles having an A expressed by an equation, $6/(D \cdot d) \leqq A < 7/(D \cdot d)$, equals to or less than 10% of the total volume of the particles.

The sixth mean is toner particles having an average diameter of d (d is in a range of 4–15 μm) characterized in that a volumetric fraction of the particles having the diameter in a range of d±0.2 d equals to or exceeds 90% of total volume of the particles, further, when a specific surface area of the toner per 1 $cm^3$ determined by a BET method is expressed by A ($m^2/g$) and a specific gravity of the particle is expressed by D ($g/cm^3$), the A of the particles stands in a range expressed by an equation, $7/(D \cdot d) \leqq A \leqq 10/(D \cdot d)$, and the toner particles are polymers obtained by polymerization reaction of at least one kind of monomers having at least an ester group.

The seventh mean is a method for manufacturing polymer toner, of which particles are deformed spherical shape, comprising the steps of;

(a) a process for aggregating reacted particles after a polymerization reaction of monomers for the polymerization in a reacting solution, (b) a process for collecting the aggregate of the reacted particles from the reacting solution, (c) a subsequent process for resolving the aggregate of the reacted particles.

The eighth mean is a method for manufacturing polymer toner having an average particle diameter of d (d is in a range of 4–15 μm) by a process comprising the steps of;

(a) a process for aggregating reacted particles after a polymerization reaction of monomers for the polymerization in a reacting solution, (b) a process for collecting the aggregate of the reacted particles from the reacting solution, (c) a process for resolving the aggregate of the reacted particles characterized in that a volumetric fraction of the obtained particles having the diameter in a range of d±0.2 d equals to or exceeds 90% of total volume of the obtained particles.

The ninth mean is a developing apparatus for forming a toner image by an electronic photograph system, wherein the toner has particles having an average diameter of d (d is in a range of 4–15 μm) and being characterized in that a volumetric fraction of the particles having the diameter in a range of d±0.2d equals to or exceeds 90% of total volume of the particles, and further, when a specific surface area of the toner per 1 $cm^3$ determined by a BET method is expressed by A ($m^2/g$) and a specific gravity of the particle is expressed by D ($g/cm^3$), the A of the particles stands in a range expressed by an equation, $7/(D \cdot d) \leqq A \leqq 10/(D \cdot d)$.

The tenth mean is a developing apparatus for forming a toner image by an electronic photograph system, wherein a resolution MTF (modulation transfer function) is at least 0.5 with 500 dots/inch.

The eleventh mean is a developing apparatus for forming a toner image by an electronic photograph system, wherein an enlarged image magnified by 10–1000 times of an original image is formed clearly.

If the average diameter d of the toner particle is less than 4 μm in the present invention, it is not preferable because the toner particle has a possibility to cause silicosis when the particles are inhaled by a mistake. And, if the average diameter d of the toner particle is larger than 15 μm, improvement of the resolution can not be realized.

When the particle size distribution of the toner particles becomes larger than ±0.2d, a distribution of the toner particle surface area becomes broader, and accordingly, a distribution of frictional electrification charges becomes wider. Consequently, the resolution of the image decreases. In accordance with the present invention, the resolution MTF (modulation transfer function) of the obtained image at least 0.5 with 500 dots/inch can be achieved by making the particle size distribution such that diameters of the particles occupying more than 90% of total sum of the particles' volume stands in a range of d±0.2d, where d is an average diameter of the particles (d is in a range of 4–15 μm). The present invention improves the resolution of the image by making the particle size distribution of the toner particles narrow, and further, the present invention makes the toner have an enough surface area for ensuring sufficient charged electricity more than 10 μC/g by deforming the substantially exact spherical shape of the polymer toner particle, and makes it possible to charge the electricity very uniform and efficiently. Consequently, it becomes possible to realize a high definition image which has not been obtained. Moreover, charging electricity more than 10 μC/g and making a distribution of amount of the charged electricity very narrow and uniform can be controlled efficiently by realizing the feature of the present invention, i.e. the toner particle has a deformed spherical shape, the toner particle has irregularities of utmost 2 μm deep on its surface, and the toner particle has a ratio of (a)/(b) less than 2 where (a) is a major axis and (b) is a minor axis of the toner particle, respectively.

A degree of the deformation of the toner particle can be determined by a specific surface area measurement of the particle. The specific surface area of the particles is usually determined by a BET method. Here, a specific surface area per 1 gram of the toner is indicated as A ($m^2/g$). If the toner is composed of exact spherical particles, the A becomes about $6/(D \cdot d)$. The toner manufactured by the polymerization method has the A of about $6/(D \cdot d)$ to $7/(D \cdot d)$. However, it is difficult to control the electrification charge of the above polymerized toner, because shapes of the toner particles are too similar with exact spheres. On the contrary, if the A of the polymerized toner exceeds $10/(D \cdot d)$, the toner particles are too deformed to have a narrow particle size distribution, and the toner particles may have a disadvantage of a large hygroscopic property. Generally, the toner obtained by the conventional pulverizing method has the A about $11/(D \cdot d)$ to $18/(D \cdot d)$.

The toner having a deformed spherical shape and the above described particle size distribution of d±0.2d (d is in a range 4–15 μm) can be obtained, for example, by the following method.

First, polymers are obtained by polymerization reaction in a solution of monomers having an ester group with predetermined blending components (a suspension polymerization is preferable). Diameters of the polymer particles are optionally adjustable depending on components, temperature, and time of the polymerization reaction.

Subsequently, the reacted solution is made alkaline after the polymerization reaction has been completed (this operation is called "alkaline treatment" hereinafter). The alkaline treatment is for hydrolysis of the ester group in the polymer. Consequently, the ester group is converted to carboxylic acid salt as shown in FIG. 1, and the polymer becomes hydrophilic. As a result, the surface of the particle absorbs water somewhat, and the particles aggregate each other to form a block having a diameter of a few millimeters. When the particles form a block of such size, filtration with a filter paper becomes possible (with the particle size before the above aggregation, clogging of pores in the filter paper occurs easily). After the filtration, washing with water is repeated in order to remove water soluble components such as dispersing agents. Next, the obtained block is mixed with an acidic liquid, and the mixture is agitated vigorously (this operation is called "acid treatment" hereinafter) to separate the block into particles having the same diameter as that of the particle of soon after the polymerization by converting the carboxylic acid salt to the carboxylic acid. Because the obtained particle hardly disperses in water, but mainly precipitates, supernatant liquid can easily be removed by decantation without centrifuging operation. The particle obtained after the decantation has a deformed shape with irregularities such as collapses and dimples at the surface. The above described changes of the particle by the alkali treatment and the acid treatment are schematically indicated in FIG. 2.

An example of prior art in which an alkali treatment is performed after polymerization is indicated in JP-A-3-113464 (1991). However, the alkali treatment in the prior art differs substantially from the alkali treatment of the present invention, because, in the prior art, monomers having carboxylic acid group are used for the polymerization and an aim of the alkali treatment is to control pH at a level that the carboxylic acid does not generate a salt (pH 4–7).

As for an agent used in making the reacted solution alkaline after the polymerization reaction, alkali metal hydroxides or alkali earth metal hydroxides both of which have large solubilities in water are preferable. Concretely saying, alkali metal hydroxides such as sodium hydroxide and potassium hydroxide, and alkali earth metal hydroxides such as magnesium hydroxide and calcium hydroxide are preferable. However, some metallic hydroxides which are scarcely soluble in water can not be thought suitable because of their difficulty in removing by washing with water. Ammonia water is also preferable because of large solubility in water. Ammonia gas also has an advantage not to increase an amount of the reacted solution so much. However, ammonia gas is poisonous and sufficient caution is required in handling for the gas leak from its vessel etc.

Preferable acidic liquids used in the operation for separating the block into particles by the acid treatment are such as aqueous solution of hydrochloric acid, nitric acid, or sulfuric acid. Aqueous solutions of the above described acids can convert carboxylic acid salts to corresponding carboxylic acids without any side reaction if their concentration is not extremely high (about 0.01–5% by weight). When organic acids such as acetic acid are used, there is an possibility to cause swelling or dissolving of the particle depending on kinds of the resin forming the particle, and sufficient caution is required.

Preferable monomers having an ester group contained in the monomers for the resin are such as alkyl methacrylates, alkyl acrylates, or vinyl acetates etc. Among them, alkyl methacrylates, or alkyl acrylates is superior to others in transparency. A case when flexibility of ink after development is required, alkyl methacrylates, or alkyl acrylates having relatively a long alkyl chain (concretely saying, the number of carbon atoms in the alkyl chain is four or more) is advantageous. A case when heat resistance of ink is required, alkyl methacrylates, or alkyl acrylates having relatively a short alkyl chain (concretely saying, the number of carbon atoms in the alkyl chain is three or less) is advantageous.

When the monomer having an ester group is contained in the monomers for the resin at least 70% by weight, there may be a case in which a fairly large fraction of the particles dissolve into water a the alkali treatment. Accordingly, the monomer having ester group is preferably contained in the monomers for the resin in a range from 5% by weight to 70% by weight.

As for the monomer having an ester group in the present invention, alkyl methacrylates, or alkyl acrylates having carbon atoms in a range from 1 to 9 is advantageous in obtaining the polymer toner relating to the present invention. That is, the above described compounds facilitate to obtain the toner having a narrow particle size distribution such as d±0.2 d and a deformed spherical shape by suspension polymerization. In the present invention, monomers having any group which can be hydrolyzed such as amido group, or imido group in addition to the ester group can be used as for the low material for the polymer, and further, the above described monomers can be used with the monomer having an ester group for copolymerization reaction.

Additives such as coloring agents, or charge control agents are added to the manufactured toner. Generally, these additives are added to the monomer at the polymerization reaction, but some additives can be added to the toner at the treatment after the polymerization reaction depending on the cases. For example, almost of charge control agents of amine group can be adsorbed by carboxyl groups at surface of the particle after the acid treatment.

The imaging apparatus can reproduce information contained in a microfilm and the like as a readable magnified image by magnifying to a several times or more from 10 to 1000 times depending on kinds of data with a combination of a plurality of lenses in an optical system of the apparatus.

As for developing methods using the toner of the present invention, either of a double components method using a carrier for charging the toner and a single component method using a brush and so on other than a carrier for charging the toner are applicable.

The aggregation of the particles after the polymerization reaction is assumed to be caused by changing the surface condition of the particles with a carboxylic acid salt generated by a hydrolysis of the ester group in the particle. Further, the reason why the particles scarcely disperse in an acidic liquid is assumed because of removal of a dispersant in the particles by the alkali treatment.

The reason why the particle obtained by the acid treatment has irregularities on its surface is assumed because of a process in which water is impregnated into the particle from its surface which has been changed to be water soluble by the hydrolysis of the ester group to make the particle swelled, and subsequently, the impregnated water is released from the particle outside by the acid treatment which decreases water solubility of the particle, or because of deformation caused by compressing surfaces of the particles each other when the particles aggregate by the alkali treatment. Further, the aggregating force of the particles at the aggregation process is extremely weaker than that of the particles which have been heated beyond its glass transition temperature (Tg) to weld each other, and accordingly, the aggregate easily reduces its size to the same size as the particle before the aggregation by only agitating the liquid after the acidic treatment with an over-head stirrer. Moreover, because the agitating operation with the over-head stirrer has a weaker mechanical impacting force than that of a ball milling operation, excessively pulverized particles are scarcely generated, and accordingly, the particles having substantially a same diameter can be obtained.

When a shape of a toner particle obtained by the polymerization process is exactly spherical, it is very difficult to give a sufficient charge to the toner which is deformed by a conventional pulverizing method even if an electrification controlling agent is added to the toner.

DETAILED DESCRIPTION OF THE EMBODIMENTS

Embodiment 1

Figure 1:
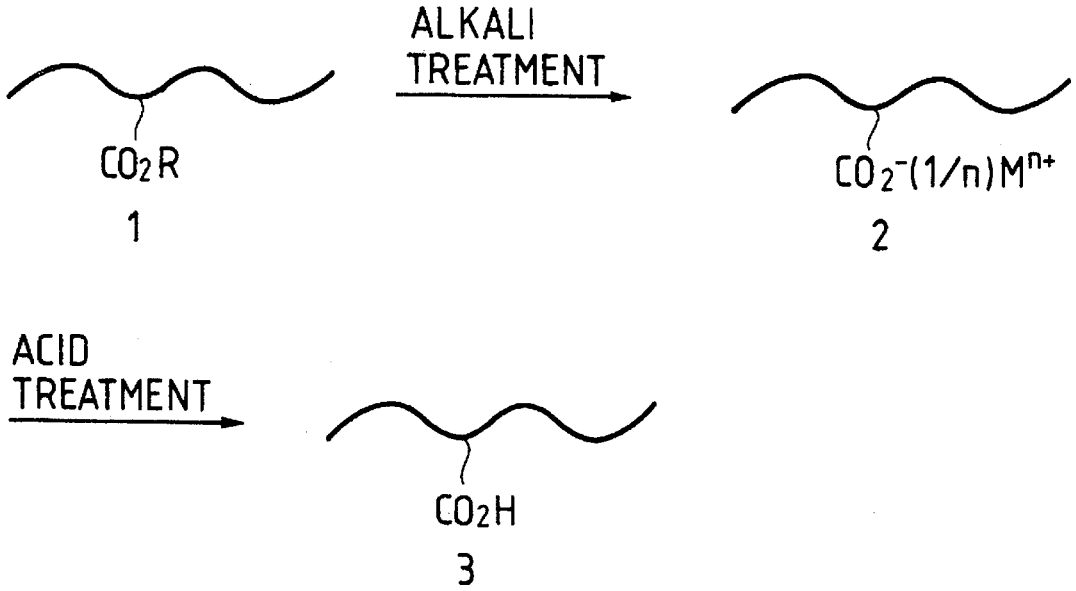
FIG. 1 is a schematic illustration for indicating changes of ester group in the resin at the particle surface by the treatments of the present invention.
Figure 2:
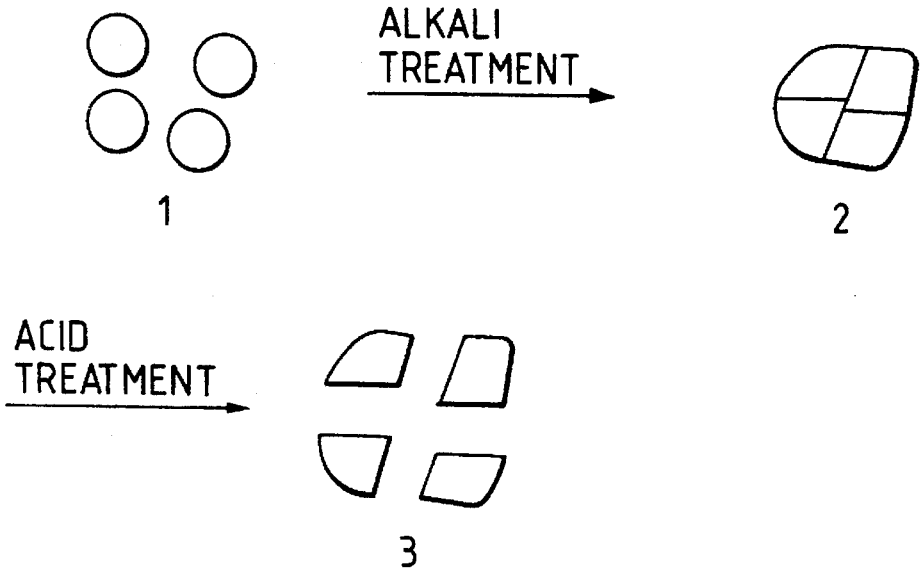
FIG. 2 is a schematic illustration for indicating changes in shapes of the particle by the treatment of the present invention.

Polymerized toner particles were prepared by the following procedure.

Polyvinyl alcohol (1 part by weight) was dissolved into warm distilled water (10 parts by weight). Subsequently, carbon black (MA-8 made by Mitsubishi Chemicals) (10 parts by weight), a charge control agent (Bontron N-03 made by Orient Chemicals) (5 parts by weight), were added to the solution, and a paste was prepared by grinding the mixture well in a mortar. Then, whole amount of the paste was mixed with the following reagents and agitated for 4 hours at 60° C. under a nitrogen atmosphere.

| | |
|---|---|
| Methyl methacrylate | 50 parts by weight |
| Stylene | 200 parts by weight |
| Polyvinyl alcohol | 1 part by weight |
| Potassium persulfate | 1 parts by weight |
| Distilled water | 1000 parts by weight |

As a result, a reacted solution in which polymerized particles having a diameter of approximately 10 μm had been dispersed was obtained.

After the above polymerization reaction was completed, the reacted solution was added with sodium hydroxide, 10 parts by weight, and the polymerized particles were aggregated by agitating the reacted solution for one minute at 60° C. The reacted solution was filtered with a filter paper (Toyo paper filter No. 2). The obtained solid was washed a several times with water, added into 1% by weight hydrochloric aqueous solution, 1000 part by weight, and agitated at 60° C. As agitating, the aggregate reduced its size by disintegration, and the polymerized particles precipitated at the bottom of the vessel by standing the solution still after the agitation until the temperature of the solution lowered to a room temperature. After removing the supernatant solution by decantation, the same amount of water as the supernatant was added to the precipitate, agitated the mixture for a while, stood the mixture still, and decanted. Subsequently, ethyl alcohol 1 part by weight was added, the mixture was agitated, and then the mixture was poured into a vat made from a metal and left for two days at a room temperature to dry it. Finally, toner particles having a diameter of approximately 10 μm were obtained by drying the particles for 3 hours at 60° C. in a drying oven.

Observation of the obtained toner particle with a microscope revealed that the particle had a shape of a flatten sphere. Maximum length of major axises of almost particles (more than 90% ) were less than two times of minimum length of minor axises each of which was across the major axis at the middle of the axis.

Determination of a particle size distribution (volumetric distribution) of the particles by a Coulter counter (Model TAII made by Coulter Co.) revealed that the maximal diameter of the particles was 10 μm and diameters of the particles occupying more than 90% of total sum of the particles' volume stand in a range of 8–12 μm. The specific gravity of the toner was 0.90. Therefore, the specific surface area A which satisfies the equation $7/(D\cdot d) \leqq A \leqq 10/(D\cdot d)$ was in a range of $0.78 \leqq A \leqq 1.11$.

The specific surface area of the toner was determined by a BET method to be 0.8 $m^2/g$ which satisfied the above range. An apparatus used in the above determination was a betasorb automatic surface area measuring apparatus model 4200 made by Nikiso Co.

An amount of electrification of the obtained toner was determined by a blow-off electrification measuring apparatus (TB-200 made by Toshiba Chemicals Co.) to be 25 μC/g with 5 minutes agitation. The above value equals to an amount of electrification obtained with a toner which was prepared by a conventional pulverizing method. A carrier used in the determination was TEFV made by Powdertech Co.

An amount of electrification of a toner which was prepared without adding the Bontron N-03 in the manufacturing process was determined in the same manner to be 4 μC/g with 5 minutes agitation. The difference of the amount of electrification in the case added with Bontron N-03 and the other case which did not use Bontron N-03 was 21 μC/g.

Figure 3:
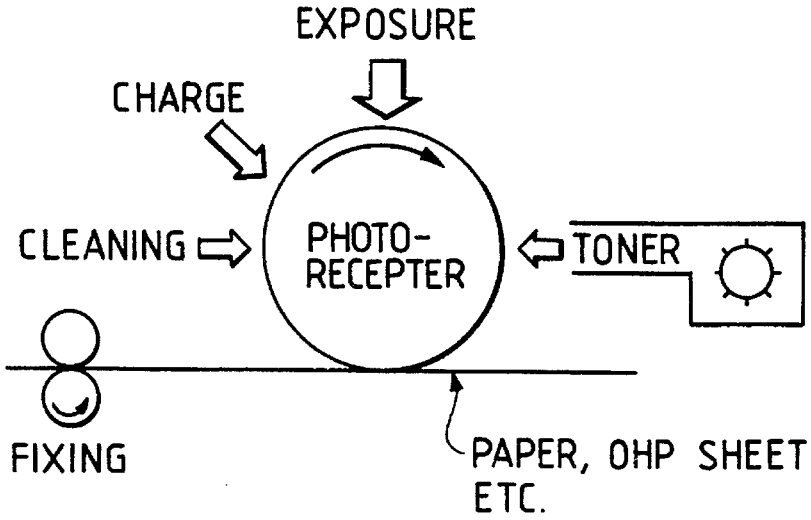
FIG. 3 is a schematic illustration for an imaging apparatus using the toner of the present invention.

FIG. 3 indicates a schematic illustration of an imaging apparatus using the toner prepared by the method of the present invention. With using the apparatus, clear images having at least 0.5 of MTF at 600 dpi are obtainable.

As for developing methods using the toner obtained in the present embodiment, either of a double components method using a carrier for charging the toner and a single component method using a brush and so on other than a carrier for charging the toner are applicable.

Figure 4:
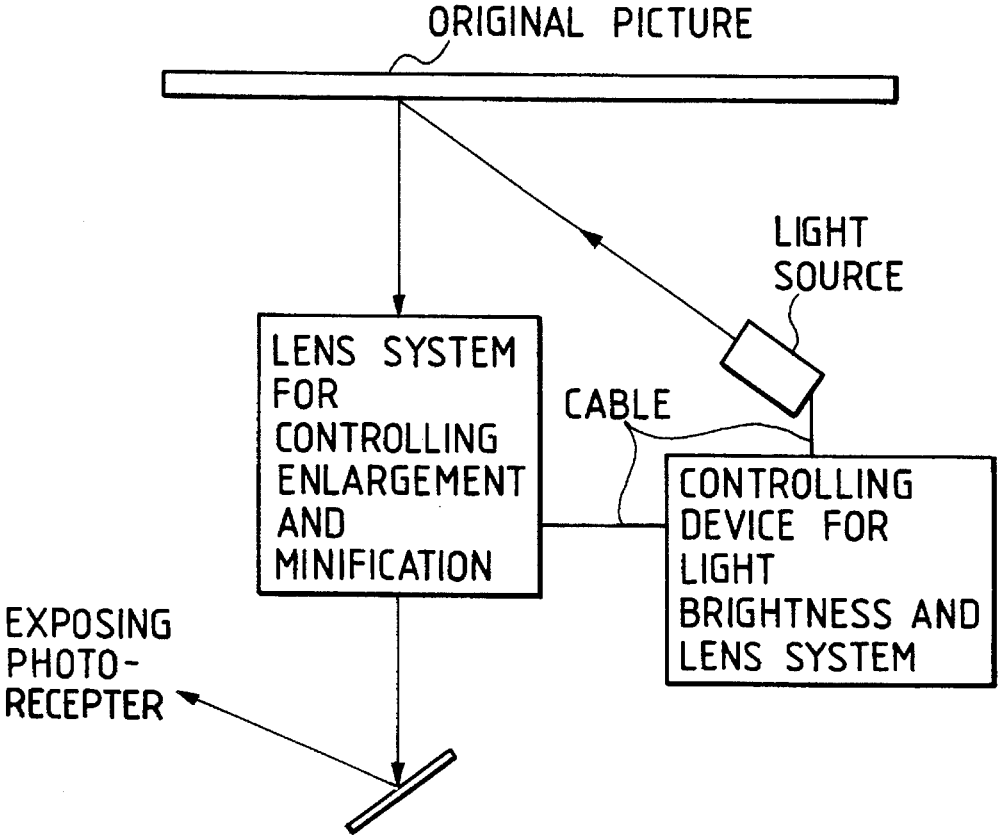
FIG. 4 is a schematic illustration for an optical system of the imaging apparatus using the toner of the present invention.

FIG. 4 indicates a schematic illustration of an optical system used in the above imaging apparatus. A the optical system, and a distance between the lenses, the numbers and kinds of the lenses are controlled corresponding to a necessary magnification. As ordinary optical microscopes are capable of magnifying an objective to 1000 times, it is possible to obtain an image having a larger magnification than that obtained by a conventional one such as a few times, or more as 10 to 1000 times.

Comparative example 1

A reacted solution in which polymerized particles having a diameter of approximately 10 μm had been dispersed was obtained in the same manner as the above embodiment 1.

A filtrating procedure was attempted on the reacted solution without adding sodium hydroxide as performed in the embodiment 1 using the same filter paper as the one used in the embodiment 1. However, it was very difficult to obtain the polymerized particles because the filter paper was clogged soon after the procedure started.

Subsequently, the reacted solution was centrifuged by 5000 rpm for 30 minutes, the supernatant liquid was discarded, the same amount of water as the discarded supernatant liquid was added to the precipitates, the mixture was agitated, and the mixture was centrifuged again. Subsequent to the above cycle repeated a several times, ethyl alcohol 1 part by weight was added to the precipitates after discarded the supernatant and agitated for mixing well. Then, the mixture was poured into a vat made from a metal, and left for two days at a room temperature to dry it. Finally, toner particles having a diameter of approximately 10 μm were obtained by drying the particles for 3 hours at 60° C. in a drying oven.

Microscopic observation of the obtained toner particle revealed that the shape of the particle was exactly a sphere.

Determination of a particle size distribution (weight distribution) of the particles by a Coulter counter (Model TAII made by Coulter Co.) revealed that the maximal diameter of the particles was 10 μm and diameters of the particles occupying more than 90% of total sum of the particles' volume stand in a range of 8–12 μm. The specific gravity of the toner was 0.90. Therefore, the specific surface area A which satisfies the equation $7/(D,d) \leqq A \leqq 10/(D \cdot d)$ was in a range of $0.78 \leqq A \leqq 1.11$.

The specific surface area of the toner was determined by the same method as the embodiment 1 to be 0.74 $m^2/g$ which did not satisfy the above range.

An amount of electrification of the obtained toner was determined by a blow-off electrification measuring apparatus (TB-200 made by Toshiba Chemicals Co.) to be 8 μC/g with 5 minutes agitation. The amount of electrification was less than 10 μC/g even if agitated for 10 minutes. A carrier used in the determination was TEFV made by Powdertech Co.

An amount of electrification of a toner which was prepared without adding the Bontron N-03 in the manufacturing process was determined in the same manner to be 2 μC/g with 5 minutes agitation. The difference of the amount of electrification in the case added with Bontron N-03 and the other case which did not use Bontron N-03 was 6 μC/g.

Embodiment 2

Using butyl acrylate (50 parts by weight) in place of methyl methacrylate (50 parts by weight) in the above embodiment 1, toner particles having a diameter of approximately 10 μm were obtained by the polymerization reaction and the post treatments in the same manner as the embodiment 1. In the post treatments, the toner particles after the alkali treatment aggregated as same as the embodiment 1, and the filtration procedure could be performed smoothly.

Microscopic observation of the obtained particle revealed that the particle had the same shape as that of the particle in the embodiment 1.

As explained above, even if the kind of the resin monomer was varied, the post treatment could be performed smoothly by the filtration procedure, and the obtained toner particle had a deformed shape.

Determination of a particle size distribution of the particles by the same method as that of the embodiment 1 revealed that the maximal diameter of the particles was 10 μm and diameters of the particles occupying more than 90% of total sum of the particles' volume stand in a range of 8–12 μm. The specific gravity of the toner was 0.90. Therefore, the specific surface area A which satisfies the equation $7/(D \cdot d) \leqq A \leqq 10/(D \cdot d)$ was in a range of $0.78 \leqq A \leqq 1.11$.

The specific surface area of the toner was determined by the same method as that of the embodiment 1 to be 0.88 $m^2/g$ which satisfied the above range.

Embodiment 3

After the polymerization reaction was performed in the same manner as the embodiment 1, the post treatments was processed in the same manner as the embodiment 1 except potassium hydroxide (10 parts by weight) was used in place of sodium hydroxide (10 parts by weight), and toner particles having a diameter of approximately 10 μm were obtained. In the post treatments, the toner particles after the alkali treatment aggregated as same as the embodiment 1, and the filtration procedure could be performed smoothly.

Microscopic observation of the obtained particle revealed that the particle had the same shape as that of the particle in the embodiment 1.

Further, a same result as the case using potassium hydroxide was obtained by using an ammonia water (25% by weight, 40 parts by weight) in place of potassium hydroxide.

As explained above, even if the kind of the reagent in the alkali treatment was varied, the post treatment could be performed smoothly by the filtration procedure, and the obtained toner particle had a deformed shape.

Determination of a particle size distribution of the particles by the same method as that of the embodiment 1 revealed that the maximal diameter of the particles was 10 μm and diameters of the particles occupying more than 90% of total sum of the particles' volume stand in a range of 8–12 μm. The specific gravity of the toner was 0.90. Therefore, the specific surface area A which satisfies the equation $7/(D \cdot d) \leqq A \leqq 10/(D \cdot d)$ was in a range of $0.78 \leqq A \leqq 1.11$.

The specific surface area of the toner was determined by the same method as that of the embodiment 1 to be 0.81 $m^2/g$ which satisfied the above range.

Embodiment 4

After the polymerization reaction and alkali treatment were performed in the same manner as the embodiment 1, the post treatments was processed in the same manner as the embodiment 1 except nitric acid (5% by weight, 1000 parts by weight) was used in place of hydrochloric acid (5% by weight, 1000 parts by weight) in the acid treatment, and toner particles having a diameter of approximately 10 μm were obtained. In the post treatments, the toner particles after the acid treatment disintegrated their aggregate and precipitated at the bottom of the vessel, and the subsequent procedure could be performed very smoothly as same as the embodiment 1.

Microscopic observation of the obtained particle revealed that the particle had the same shape as that of the particle obtained in the embodiment 1.

As explained above, even if the kind of the reagent in the acid treatment was varied, the post treatment could be performed smoothly by the filtration procedure, and the obtained toner particle had a deformed shape.

Determination of a particle size distribution of the particles by the same method as that of the embodiment 1 revealed that the maximal diameter of the particles was 10 μm and diameters of the particles occupying more than 90% of total sum of the particles' volume stand in a range of 8–12 μm. The specific gravity of the toner was 0.90. Therefore, the specific surface area A which satisfies the equation $7/(D \cdot d) \leqq A \leqq 10/(D \cdot d)$ was in a range of $0.78 \leqq A \leqq 1.11$.

The specific surface area of the toner was determined by the same method as that of the embodiment 1 to be 0.81 $m^2/g$ which satisfied the above range.

Embodiment 5

Polymerized toner particles were prepared by the following procedure.

Polyvinyl alcohol (1 part by weight) was dissolved into warm distilled water (10 parts by weight). Subsequently, carbon black (MA-8 made by Mitsubishi Chemicals) (10 parts by weight), a charge control agent (Bontron N-34 made by Orient Chemicals) (5 parts by weight), were added to the solution, and a paste was prepared by grinding the mixture well in a mortar. Then, whole amount of the paste was mixed with the following reagents and agitated for 4 hours at 60° C. under a nitrogen atmosphere.

| | |
|---|---|
| Methyl methacrylate | 50 parts by weight |
| Stylene | 200 parts by weight |
| Polyvinyl alcohol | 1 part by weight |
| Potassium persulfate | 1 parts by weight |
| Distilled water | 1000 parts by weight |

As a result, a reacted solution in which polymerized particles having a diameter of approximately 10 μm had been dispersed was obtained.

After the above polymerization reaction was completed, the reacted solution was added with sodium hydroxide, 10 parts by weight, and agitated for one minute at 60° C. to aggregate the polymerized particles. The reacted solution was filtered with a filter paper (Toyo paper filter No. 2). The obtained solid was washed a several times with water, added into 1% by weight hydrochloric aqueous solution, 1000 part by weight, and agitated at 60° C. As agitating, the aggregate reduced its size by disintegration, and the polymerized particles precipitated at the bottom of the vessel by standing the solution still after the agitation until the temperature of the solution lowered to a room temperature. After removing the supernatant solution by decantation, the same amount of water as the supernatant was added to the precipitate, agitated the mixture for a while, stood the mixture still, and decanted. Subsequently, ethyl alcohol 1 part by weight was added to the precipitate, the mixture was agitated, and then the mixture was poured into a vat made from a metal and left for two days at a room temperature to dry it. Finally, toner particles having a diameter of approximately 10 μm were obtained by drying the particles for 3 hours at 60° C. in a drying oven.

Observation of the obtained toner particle with a microscope revealed that the particle had a shape of a flatten sphere. Maximum length of major axises of almost particles (more than 90%) were less than two times of minimum length of minor axises each of which was across the major axis at the middle of the axis.

Determination of a particle size distribution of the particles by the same method as that of the embodiment 1 revealed that the maximal diameter of the particles was 10 μm and diameters of the particles occupying more than 90% of total sum of the particles' volume stand in a range of 8–12 μm. The specific gravity of the toner was 0.90. Therefore, the specific surface area A which satisfies the equation $7/(D\cdot d) \leqq A \leqq 10/(D\cdot d)$ was in a range of $0.78 \leqq A \leqq 1.11$.

The specific surface area of the toner was determined by the same method as that of the embodiment 1 to be 0.80 $m^2/g$ which satisfied the above range.

An amount of electrification of the obtained toner was determined by a blow-off electrification measuring apparatus (TB-200 made by Toshiba Chemicals Co.) to be 22 μC/g with 5 minutes agitation. The above value equals to an amount of electrification obtained with a toner which was prepared by a conventional pulverizing method. A carrier used in the determination was TEFV made by Powdertech Co.

An amount of electrification of a toner which was prepared without adding the Bontron S-34 in the manufacturing process was determined in the same manner to be 4 μC/g with 5 minutes agitation. The difference of the amount of electrification in the case added with Bontron S-34 and the other case which did not use Bontron S-34 was 26 μC/g .

FIG. 3 indicates a schematic illustration of an imaging apparatus using the toner prepared by the method of the present invention. With using the apparatus, clear images having at least 0.5 of MTF at 600 dpi are obtainable.

FIG. 4 indicates a schematic illustration of an optical system used in the above imaging apparatus. A plurality of lenses are associated with each other in the optical system, and a distance between the lenses, the numbers and kinds of the lenses are controlled corresponding to a necessary magnification. As ordinary optical microscopes are capable of magnifying an objective to 1000 times, it is possible to obtain an image having a larger magnification than that obtained by a conventional one such as a few times, or more as 10 to 1000 times.

Embodiment 6

Polymerized toner particles were prepared by the following procedure.

Polyvinyl alcohol (1 part by weight) was dissolved into warm distilled water (10 parts by weight). Subsequently, carbon black (MA-8 made by Mitsubishi Chemicals) (10 parts by weight), a charge control agent (Bontron N-04 made by Orient Chemicals) (5 parts by weight), were added to the solution, and a paste was prepared by grinding the mixture well in a mortar. Then, whole amount of the paste was mixed with the following reagents and agitated for 4 hours at 60° C. under a nitrogen atmosphere.

| | |
|---|---|
| Methyl methacrylate | 60 parts by weight |
| Stylene | 200 parts by weight |
| Polyvinyl alcohol | 1 part by weight |
| Potassium persulfate | 1 parts by weight |
| Distilled water | 1000 parts by weight |

As a result, a reacted solution in which polymerized particles having a diameter of approximately 11 μm had been dispersed was obtained.

After the above polymerization reaction was completed, the reacted solution was added with sodium hydroxide, 10 parts by weight, and agitated for one minute at 60° C. to aggregate the polymerized particles. The reacted solution was filtered with a filter paper (Toyo paper filter No. 2). The obtained solid was washed a several times with water, added into 1% by weight hydrochloric aqueous solution, 1000 part by weight, and agitated at 60° C. As agitating, the aggregate reduced its size by disintegration, and the polymerized particles precipitated at the bottom of the vessel by standing the solution still after the agitation until the temperature of the solution lowered to a room temperature. After removing the supernatant solution by decantation, the same amount of water as the supernatant was added to the precipitate, agitated the mixture for a while, stood the mixture still, and decanted. Subsequently, ethyl alcohol 1 part by weight was added to the precipitate, the mixture was agitated, and then the mixture was poured into a vat made from a metal and left for two days at a room temperature to dry it. Finally, toner particles having a diameter of approximately 11 μm were obtained by drying the particles for 3 hours at 60° C. in a drying oven.

Observation of the obtained toner particle with a microscope revealed that the particle had a shape of a flatten sphere. Maximum length of major axises of almost particles (more than 90% ) were less than two times of minimum length of minor axises each of which was across the major axis at the middle of the axis.

Determination of a particle size distribution of the particles by the same method as that of the embodiment 1 revealed that the maximal diameter of the particles was 11 μm and diameters of the particles occupying more than 90% of total sum of the particles' volume stand in a range of 9–13 μm. The specific gravity of the toner was 0.90. Therefore, the specific surface area A which satisfies the equation $7/(D\cdot d) \leqq A \leqq 10/(D\cdot d)$ was in a range of $0.71 \leqq A \leqq 1.01$.

The specific surface area of the toner was determined by the same method as that of the embodiment 1 to be 0.74 $m^2/g$ which satisfied the above range.

An amount of electrification of the obtained toner was determined by a blow-off electrification measuring apparatus (TB-200 made by Toshiba Chemicals Co.) to be 20 μC/g with 5 minutes agitation. The above value equals to an amount of electrification obtained with a toner which was prepared by a conventional pulverizing method. A carrier used in the determination was TEFV made by Powdertech Co.

An amount of electrification of a toner which was prepared without adding the Bontron N-04 in the manufacturing process was determined in the same manner to be 4 μC/g with 5 minutes agitation. The difference of the amount of electrification in the case added with Bontron N-04 and the other case which did not use Bontron N-04 was 16 μC/g.

FIG. 3 indicates a schematic illustration of an imaging apparatus using the toner prepared by the method of the present invention. With using the apparatus, clear images having at least 0.5 of MTF at 600 dpi are obtainable.

FIG. 4 indicates a schematic illustration of an optical system used in the above imaging apparatus. A plurality of lenses are associated with each other in the optical system, and a distance between the lenses, the numbers and kinds of the lenses are controlled corresponding to a necessary magnification. As ordinary optical microscopes are capable of magnifying an objective to 1000 times, it is possible to obtain an image having a larger magnification than that obtained by a conventional one such as a few times, or more as 10 to 1000 times.

Embodiment 7

Polymerized toner particles were prepared by the following procedure.

Polyvinyl alcohol (1 part by weight) was dissolved into warm distilled water (10 parts by weight). Subsequently, carbon black (MA-8 made by Mitsubishi Chemicals) (10 parts by weight), a charge control agent (Bontron N-03 made by Orient Chemicals) (5 parts by weight), were added to the solution, and a paste was prepared by grinding the mixture well in a mortar. Then, whole amount of the paste was mixed with the following reagents and agitated for 4 hours at 60° C. under a nitrogen atmosphere.

| | |
|---|---|
| Hexyl methacrylate | 150 parts by weight |
| Stylene | 200 parts by weight |
| Polyvinyl alcohol | 20 part by weight |
| Potassium persulfate | 1 parts by weight |
| Distilled water | 1000 parts by weight |

As a result, a reacted solution in which polymerized particles having a diameter of approximately 5 μm had been dispersed was obtained.

After the above polymerization reaction was completed, the reacted solution was added with sodium hydroxide, 10 parts by weight, and agitated for one minute at 60° C. to aggregate the polymerized particles. The reacted solution was filtered with a filter paper (Toyo paper filter No. 2). The obtained solid was washed a several times with water, added into 1% by weight hydrochloric aqueous solution, 1000 part by weight, and agitated at 60° C. As agitating, the aggregate reduced its size by disintegration, and the polymerized particles precipitated at the bottom of the vessel by standing the solution still after the agitation until the temperature of the solution lowered to a room temperature. After removing the supernatant solution by decantation, the same amount of water as the supernatant was added to the precipitate, agitated the mixture for a while, stood the mixture still, and decanted. Subsequently, ethyl alcohol 1 part by weight was added to the precipitate, the mixture was agitated, and then the mixture was poured into a vat made from a metal and left for two days at a room temperature to dry it. Finally, toner particles having a diameter of approximately 5 μm were obtained by drying the particles for 3 hours at 60° C. in a drying oven. Observation of the obtained toner particle with a microscope revealed that the particle had a shape of a flatten sphere. Maximum length of major axises of almost particles (more than 90%) were less than two times of minimum length of minor axises each of which was across the major axis at the middle of the axis.

Determination of a particle size distribution of the particles by the same method as that of the embodiment 1 revealed that the maximal diameter of the particles was 5 μm and diameters of the particles occupying more than 90% of total sum of the particles' volume stand in a range of 4–6 μm. The specific gravity of the toner was 0.90. Therefore, the specific surface area A which satisfies the equation $7/(D\cdot d) \leqq A \leqq 10/(D\cdot d)$ was in a range of $1.56 \leqq A \leqq 2.22$.

The specific surface area of the toner was determined by the same method as that of the embodiment 1 to be 1.69 $m^2/g$ which satisfied the above range.

An amount of electrification of the obtained toner was determined by a blow-off electrification measuring apparatus (TB-200 made by Toshiba Chemicals Co.) to be 30 μC/g with 5 minutes agitation. The above value equals to an amount of electrification obtained with a toner which was prepared by a conventional pulverizing method. A carrier used in the determination was TEFV made by Powdertech Co.

An amount of electrification of a toner which was prepared without adding the Bontron N-03 in the manufacturing process was determined in the same manner to be 5 μC/g with 5 minutes agitation. The difference of the amount of electrification in the case added with Bontron N-03 and the other case which did not use Bontron N-03 was 25 μC/g .

FIG. 3 indicates a schematic illustration of an imaging apparatus using the toner prepared by the method of the present invention. With using the apparatus, clear images having at least 0.5 of MTF at 600 dpi are obtainable.

FIG. 4 indicates a schematic illustration of an optical system used in the above imaging apparatus. A plurality of lenses are associated with each other in the optical system, and a distance between the lenses, the numbers and kinds of the lenses are controlled corresponding to a necessary magnification. As ordinary optical microscopes are capable of magnifying an objective to 1000 times, it is possible to obtain an image having a larger magnification than that obtained by a conventional one such as a few times, or more as 10 to 1000 times.

Embodiment 8

Polymerized toner particles were prepared by the following procedure.

Polyvinyl alcohol (1 part by weight) was dissolved into warm distilled water (10 parts by weight). Subsequently, carbon black (MA-8 made by Mitsubishi Chemicals) (10 parts by weight), a charge control agent (Bontron N-03 made by Orient Chemicals) (5 parts by weight), were added to the solution, and a paste was prepared by grinding the mixture well in a mortar. Then, whole amount of the paste was mixed with the following reagents and agitated for 4 hours at 60° C. under a nitrogen atmosphere.

| | |
|---|---|
| Methyl methacrylate | 25 parts by weight |
| Butyl acrylate | 25 parts by weight |
| Stylene | 200 parts by weight |
| Polyvinyl alcohol | 5 part by weight |
| Potassium persulfate | 1 parts by weight |
| Distilled water | 1000 parts by weight |

As a result, a reacted solution in which polymerized particles having a diameter of approximately 8 μm had been dispersed was obtained.

After the above polymerization reaction was completed, the reacted solution was added with sodium hydroxide, 10 parts by weight, and agitated for one minute at 60° C. to aggregate the polymerized particles. The reacted solution was filtered with a filter paper (Toyo paper filter No. 2). The obtained solid was washed a several times with water, added into 1% by weight hydrochloric aqueous solution, 1000 part by weight, and agitated at 60° C. As agitating, the aggregate reduced its size by disintegration, and the polymerized particles precipitated at the bottom of the vessel by standing the solution still after the agitation until the temperature of the solution lowered to a room temperature. After removing the supernatant solution by decantation, the same amount of water as the supernatant was added to the precipitate, agitated the mixture for a while, stood the mixture still, and decanted. Subsequently, ethyl alcohol 1 part by weight was added to the precipitate, the mixture was agitated, and then the mixture was poured into a vat made from a metal and left for two days at a room temperature to dry it. Finally, toner particles having a diameter of approximately 8 μm were obtained by drying the particles for 3 hours at 60° C. in a drying oven. Observation of the obtained toner particle with a microscope revealed that the particle had a shape of a flatten sphere. Maximum length of major axises of almost particles (more than 90%) were less than two times of minimum length of minor axises each of which was across the major axis at the middle of the axis.

Determination of a particle size distribution of the particles by the same method as that of the embodiment 1 revealed that the maximal diameter of the particles was 8 μm and diameters of the particles occupying more than 90% of total sum of the particles' volume stand in a range of 6.5–9.5 μm. The specific gravity of the toner was 0.90. Therefore, the specific surface area A which satisfies the equation $7/(D\cdot d) \leqq A \leqq 10/(D,d)$ was in a range of $0.97 \leqq A \leqq 1.39$.

The specific surface area of the toner was determined by the same method as that of the embodiment 1 to be 1.08 $m^2/g$ which satisfied the above range.

An amount of electrification of the obtained toner was determined by a blow-off electrification measuring apparatus (TB-200 made by Toshiba Chemicals Co.) to be 27 μC/g with 5 minutes agitation. The above value equals to an amount of electrification obtained with a toner which was prepared by a conventional pulverizing method. A carrier used in the determination was TEFV made by Powdertech Co.

An amount of electrification of a toner which was prepared without adding the Bontron N-03 in the manufacturing process was determined in the same manner to be 4 μC/g with 5 minutes agitation. The difference of the amount of electrification in the case added with Bontron N-03 and the other case which did not use Bontron N-03 was 23 μC/g .

FIG. 3 indicates a schematic illustration of an imaging apparatus using the toner prepared by the method of the present invention. With using the apparatus, clear images having at least 0.5 of MTF at 600 dpi are obtainable.

FIG. 4 indicates a schematic illustration of an optical system used in the above imaging apparatus. A plurality of lenses are associated with each other in the optical system, and a distance between the lenses, the numbers and kinds of the lenses are controlled corresponding to a necessary magnification. As ordinary optical microscopes are capable of magnifying an objective to 1000 times, it is possible to obtain an image having a larger magnification than that obtained by a conventional one such as a few times, or more as 10 to 1000 times.

As explained above, an advantage of the present invention is to provide toner having a very narrow particle size distribution and preferable uniformity which can improve a resolution of image by making the particle size distribution of the toner narrow, and increase an amount of electrification of the toner particle to equal to or more 10 μC/g by making the shape of the particle deformed. High definition of image can be effectively controlled by using the toner obtained in accordance with the present invention.

What is claimed is:

1. Toner particles having an average diameter of d (d is in a range of 4–15 μm) characterized in that a volumetric fraction of the particles having the diameter in a range of d±0.2 d equals to or exceeds 90% of total volume of the particles, and further, when a specific surface area of the toner per 1 $cm^3$ determined by a BET method is expressed by A ($m^2/g$) and a specific gravity of the particle is expressed by D ($g/cm^3$), A of the particles stands in a range expressed by an equation, $7/(D\cdot d) \leqq A \leqq 10/(D\cdot d)$.

2. Toner particles having an average diameter of d (d is in a range of 4–15 μm) characterized in that a volumetric fraction of the particles having the diameter in a range of d±0.2 d equals to or exceeds 90% of total volume of the particles, further, when a specific surface area of the toner per 1 $cm^3$ determined by a BET method is expressed by A ($m^2/g$) and a specific gravity of the particle is expressed by D ($g/cm^3$), A of the particles stands in a range expressed by an equation, $7/(D\cdot d) \leqq A \leqq 10/(D\cdot d)$, and of which surface has irregularities of utmost 2 μm deep.

3. Toner particles having an average diameter of d (d is in a range of 4–15 μm) characterized in that a volumetric fraction of the particles having the diameter in a range of d±0.2 d equals to or exceeds 90% of total volume of the particles, further, when a specific surface area of the toner per 1 $cm^3$ determined by a BET method is expressed by A ($m^2/g$) and a specific gravity of the particle is expressed by D ($g/cm^3$), A of the particles stands in a range expressed by an equation, $7/(D\cdot d) \leqq A \leqq 10/(D\cdot d)$, and of which (a)/(b) is less than 2 where (a) is a major axis and (b) is a minor axis of the toner particle, respectively.

4. Toner particles having an average diameter of d (d is in a range of 4–15 μm) characterized in that a volumetric fraction of the particles having the diameter in a range of d±0.2 d equals to or exceeds 90% of total volume of the particles, further, when a specific surface area of the toner per 1 $cm^3$ determined by a BET method is expressed by A ($m^2/g$) and a specific gravity of the particle is expressed by D ($g/cm^3$), A of the particles stands in a range expressed by an equation, $7/(D\cdot d) \leqq A \leqq 10/(D\cdot d)$, and of which absolute charged electricity is at least 10 μC/g (determined with a blow off charged electricity measuring apparatus).

5. Toner particles as claimed in any one of claims 1 to 4, wherein said toner particles are polymerized toner particles.

6. Toner particles having an average diameter of d (d is in a range of 4–15 μm) characterized in that a volumetric fraction of the particles having the diameter in a range of d±0.2 d equals to or exceeds 90% of total volume of the particles, further, when a specific surface area of the toner per 1 $cm^3$ determined by a BET method is expressed by A ($m^2/g$) and a specific gravity of the particle is expressed by D ($g/cm^3$), the A of the particles stands in a range expressed by an equation, $7/(D\cdot d) \leqq A \leqq 10/(D\cdot d)$, and a volumetric fraction of the particles having an A expressed by an equation, $6/(D\cdot d) \leqq A < 7/(D\cdot d)$ equals to or less than 10% of the total volume of the particles.

7. Polymerized toner particles having an average diameter of d (d is in a range of 4–15 μm) characterized in that a volumetric fraction of the particles having the diameter in a range of d±0.2 d equals to or exceeds 90% of total volume of the particles, further, when a specific surface area of the toner per 1 $cm^3$ determined by a BET method is expressed by A ($m^2/g$) and a specific gravity of the particle is expressed by D ($g/cm^3$), the A of the particles stands in a range expressed by an equation, $7/(D\cdot d) \leqq A \leqq 10/(D\cdot d)$, and the toner particles are polymers obtained by polymerization reaction of at least one kind of monomer having at least an ester group.

8. Polymerized toner particles as claimed in claim 7, wherein said monomer having at least one ester group is selected from the group consisting of alkyl methacrylate and alkyl acrylate.

9. A developing apparatus for forming a toner image by an electronic photograph system, wherein the toner has particles having an average diameter of d (d is in a range of 4–15 μm) and being characterized in that a volumetric fraction of the particles having the diameter in a range of d±0.2 d equals to or exceeds 90% of total volume of the particles, and further, when a specific surface area of the toner per 1 $cm^3$ determined by a BET method is expressed by A ($m^2/g$) and a specific gravity of the particle is expressed by D ($g/cm^3$), the A of the particles stands in a range expressed by an equation, $7/(D\cdot d) \leqq A \leqq 10/(D\cdot d)$.

10. A developing apparatus for forming a toner image by an electrophotographic system, wherein a MTF (Modulation Transfer Function) of an obtainable image is at least 0.5 with 500 dots/inch and wherein toner before fixing said image comprises particles having an average diameter of d (d is in a range of 4–15 μm) characterized in that a volumetric fraction of the particles having the diameter in a range of d±0.2 d equals to or exceeds 90% of total volume of the particles, and further, when a specific surface area of the toner per 1 $cm^3$ determined by a BET method is expressed by A ($m^2/g$) and a specific gravity of the particle is expressed by D ($g/cm^3$), A of the particles stands in a range expressed by an equation, $7/(D\cdot d) \leqq A \leqq 10/(D\cdot d)$.

11. A developing apparatus for forming a toner image by an electrophotographic system, wherein an enlarged image magnified by 10–1000 times of an original picture is formed with a preferable definition and wherein toner before fixing said image comprises particles having an average diameter of d (d is in a range of 4–15 μm) characterized in that a volumetric fraction of the particles having the diameter in a range of d±0.2 d equals to or exceeds 90% of total volume of the particles, and further, when a specific surface area of the toner per 1 $cm^3$ determined by a BET method is expressed by A ($m^2/g$) and a specific gravity of the particle is expressed by D ($g/cm^3$), A of the particles stands in a range expressed by an equation, $7/(D\cdot d) \leqq A \leqq 10/(D\cdot d)$.

12. A developing apparatus as claimed in claim 10 or claim 11, wherein a method using for the forming toner image is a double components developing method comprising a toner and a carrier.

* * * * *